US010589330B2

(12) United States Patent
Lindner et al.

(10) Patent No.: US 10,589,330 B2
(45) Date of Patent: Mar. 17, 2020

(54) METHOD AND SYSTEM FOR PRODUCING OPEN OR CLOSED ANNULAR STRUCTURAL COMPONENTS MADE OF LIGHT METAL AND ALLOYS THEREOF

(71) Applicant: Ulrich Bruhnke, Ehningen (DE)

(72) Inventors: Karl-Heinz Lindner, Muelheim (DE); Andreas Jaeger, Dortmund (DE)

( * ) Notice: Subject to any disclaimer, the term of this patent is extended or adjusted under 35 U.S.C. 154(b) by 467 days.

(21) Appl. No.: 15/318,604

(22) PCT Filed: May 19, 2015

(86) PCT No.: PCT/DE2015/000250

§ 371 (c)(1),
(2) Date: Dec. 13, 2016

(87) PCT Pub. No.: WO2015/188801

PCT Pub. Date: Dec. 17, 2015

(65) Prior Publication Data

US 2017/0128994 A1 May 11, 2017

(30) Foreign Application Priority Data

Jun. 13, 2014 (DE) ..... 10 2014 008 646

(51) Int. Cl.

| | |
|---|---|
| ***B21C 23/12*** | (2006.01) |
| ***B21C 23/14*** | (2006.01) |
| ***B21D 53/16*** | (2006.01) |

(52) U.S. Cl.

CPC ..... *B21C 23/12* (2013.01); *B21C 23/142* (2013.01); *B21D 53/16* (2013.01)

(58) Field of Classification Search

CPC ..... B21D 53/16; B21D 53/30; B21C 23/12; B21C 23/142; B21C 35/02; B21C 35/023; B21C 35/026; B21C 25/10

See application file for complete search history.

(56) References Cited

U.S. PATENT DOCUMENTS

| | | | | |
|---|---|---|---|---|
| 5,305,625 | A | 4/1994 | Heinz | |
| 2003/0019105 | A1* | 1/2003 | Chen | B21D 53/30 29/894.351 |
| 2004/0025977 | A1* | 2/2004 | Schroepfer | B21D 53/30 148/524 |
| 2004/0045335 | A1 | 3/2004 | Lindner et al. | |

(Continued)

FOREIGN PATENT DOCUMENTS

| | | |
|---|---|---|
| CA | 1 078 153 A1 | 5/1980 |
| DE | 26 11 200 A1 | 9/1977 |

(Continued)

*Primary Examiner* — Pradeep C Battula
(74) *Attorney, Agent, or Firm* — Smartpat PLC

(57) ABSTRACT

A method and to a system for producing open or closed annular structural components made of light metal and alloys thereof, preferably of magnesium or magnesium alloys, having a two-dimensional or three-dimensional structure by means of extrusion, wherein the extruded profile exiting the die of the extrusion press is formed into a helical shape by way of one or more guide tools, and more particularly such that the ends of the helical shape are separated from the extruded strand in the region of the overlap and formed into a two-dimensional or three-dimensional structural component in a shaping device.

9 Claims, 1 Drawing Sheet

(56) References Cited

U.S. PATENT DOCUMENTS

| | | | | |
|---|---|---|---|---|
| 2007/0169346 | A1* | 7/2007 | Hui | B21D 53/30<br>29/894.35 |
| 2012/0304723 | A1* | 12/2012 | Abe | B21D 53/30<br>72/68 |

FOREIGN PATENT DOCUMENTS

| | | | |
|---|---|---|---|
| DE | 10241028 | B3 | 7/2004 |
| DE | 103 17 080 | A1 | 11/2004 |
| DE | 10 2011 112559 | A1 | 3/2013 |
| DE | 102014008646 | B3 | 9/2015 |
| EP | 0706843 | A1 | 4/1996 |
| JP | S63273571 | A | 11/1988 |
| JP | 3-47615 | A | 2/1991 |
| JP | H0347815 | A | 2/1991 |

* cited by examiner

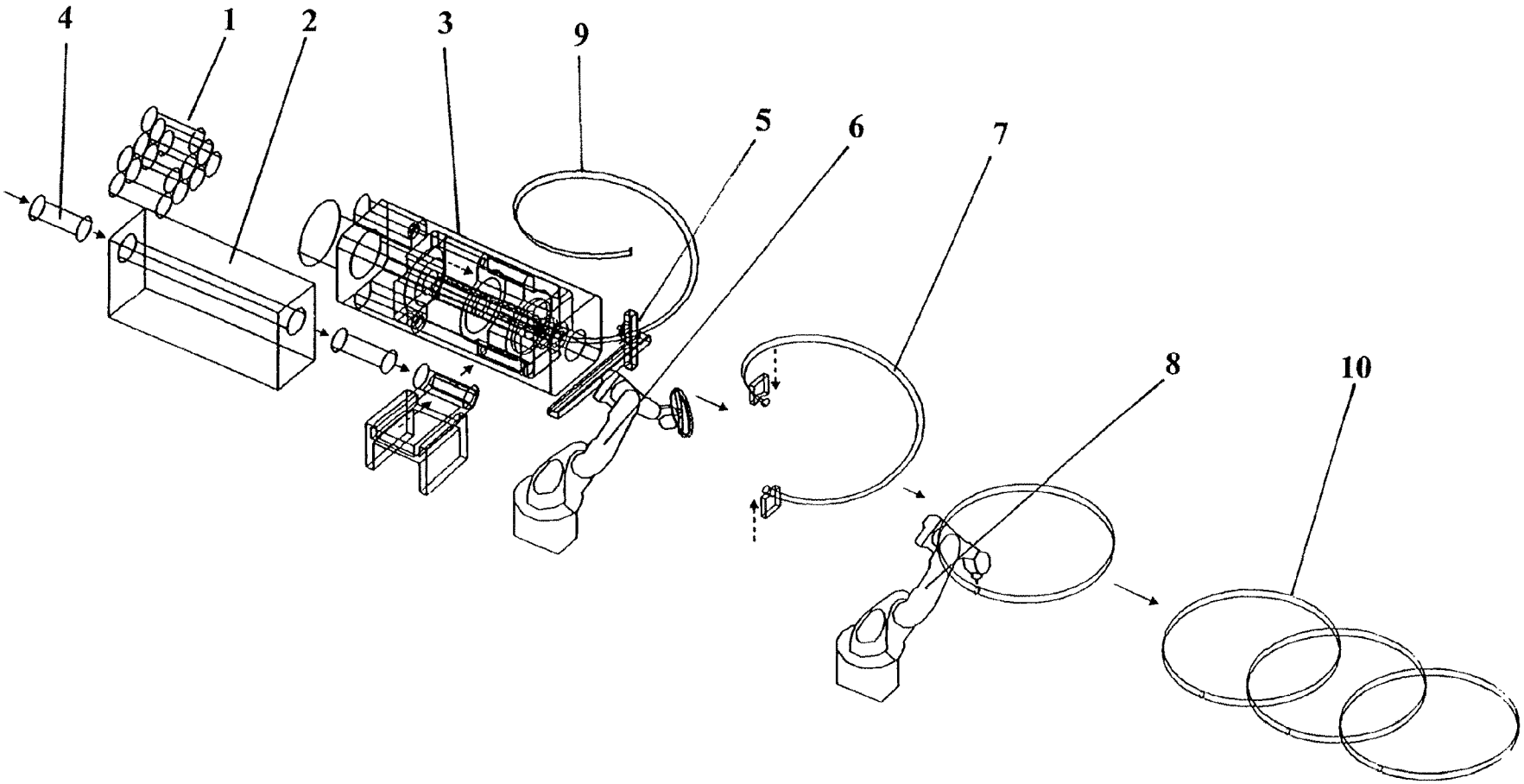
1
2
3
4
5
6
7
8
9
10

METHOD AND SYSTEM FOR PRODUCING OPEN OR CLOSED ANNULAR STRUCTURAL COMPONENTS MADE OF LIGHT METAL AND ALLOYS THEREOF

BACKGROUND OF THE INVENTION

The invention relates to a method and to a system for producing open or closed annular structural components made of light metal and alloys thereof, preferably magnesium or magnesium alloys, having a two-dimensional or three-dimensional structure by means of extrusion.

In the field of automotive engineering, the space frame concept is known. This type of body construction uses a skeleton composed of closed hollow profiles, which are joined to each other directly or via nodes. By using aluminum or magnesium materials, a reduction in fuel consumption and emissions can be achieved due to weight savings.

EP 0706843 B1 describes a method for producing curved hollow profiles by combining extrusion and bending, and a device for carrying out the method, wherein the hollow profile is bent by a force acting on the workpiece transversely to the extruder, during or immediately after the forming extrusion operation. According to the invention, EP 0706843 B1 describes an intended curving of extruded profiles by way of rounding, using no subsequent hot forming process.

A method for extruding curved profiles is known from U.S. Pat. No. 5,305,625, in which differing frictional resistances on the inner surface of the extrusion die create a local retardation or acceleration of the flow process during extrusion. Due to differing friction conditions, a curved profile exits the die, the profile being guided over a bent discharge section, but not being formed to any greater extent.

A method and a device for producing curved hollow profiles are known from JP-A-03 47815, in which a pressurized gas is trapped inside the hollow profile during the bending operation. A guide member is disposed at a distance from die outlet, wherein the movement of the guide member transversely to the extrusion direction brings about curving of the hollow profile.

Among the known methods for directly rounding an extruded profile upon exiting the die by the exertion of a controlled transverse force so as to bend a profile, creating the necessary contour, poses almost insurmountable technical difficulties, especially in the case of three-dimensional profiles having a variable curvature.

To satisfy the technical requirements, it has already been proposed to shape the contour and the cross-section by way of internal high pressure forming (IHF) of the extruded profile. The disadvantage in this is the enormously high tooling costs.

Furthermore, a method for producing curved (rounded) structural components from an extruded profile, in particular made of aluminum, magnesium or alloys thereof, is known from DE 102 41 028 B3, in which the extruded profile, after exiting the die of the extrusion press, is guided by one or more guide tools for the purpose of being formed into a straight or curved (rounded) profile, and an end section is cut off by a separating tool and fed in the hot state to a hot forming process and to one or more processing stations by way of gripping tools, wherein, prior to the hot forming process or prior to other processing stations, the hot forming temperature is set to the optimal process temperature by cooling the workpiece.

SUMMARY OF THE INVENTION

Proceeding from the prior art, it is the object of the invention to provide an improved method for producing endless annular structural components having a polygonal shape with corner regions, in particular for motor vehicles, made of light metal and alloys thereof, having a two-dimensional or three-dimensional structure, in which, proceeding from the extrusion process, structural components having a particularly high precision in terms of the dimensional accuracy thereof and the shape accuracy thereof can be produced.

It is a further object to provide a system for carrying out the method so as to produce an annular structural component as a ready-to-install component.

According to the invention, provided is a method for producing a structural component, comprising extruding a light metal or alloy thereof through a die of an extrusion press to provide an extruded profile in a form of a continuous strip of the light metal or alloy, separating a predetermined length of the extruded profile from the continuous strip and guiding the predetermined length of the profile into a helical configuration as the continuous strip exits the die to provide a discrete helical profile having two ends, the length being predetermined such that the two ends overlap sufficiently to provide a site for inseparably connecting the two ends to form the discrete helical profile into an endless configuration constituting the structural component.

Furthermore, the light metal is especially magnesium, meaning the method is preferably aimed at magnesium and magnesium alloys.

Moreover, the two ends may be inseparably connected at the overlap to form the discrete helical profile into the endless configuration constituting the structural component.

Generally, the guiding of the predetermined length of the profile into the helical configuration as it exits the die is carried out while the profile is still in a heated, formable state.

The system for producing the structural component by the aforementioned method comprises a production line comprising, in the following sequence:

- a site for storage of ingots of the metal or metal alloy;
- furnace configured to receive and heat the ingots;
  - the extrusion press having the die, the extrusion press being configured to receive the heated ingots from the furnace; and
  - tools configured to separate the predetermined length of the profile from the continuous strip and to receive and guide the predetermined length of the continuous strip into the helical configuration as the continuous strip exits the die.

The system may further comprise a device for the inseparable connecting of the two ends at the overlap to provide the endless structural component.

The method for producing open or closed annular structural components made of light metal and alloys thereof, preferably of magnesium or magnesium alloys, having a two-dimensional or three-dimensional structure comprises the following steps:—producing an annular structural component from an extruded profile having a helical shape exiting the extrusion press, wherein the ends overlap slightly;—separating the helical shape from the extruded strand in the location of the overlap; and—shaping the helical shape produced from the extruded profile to yield a two-dimensional or three-dimensional structural component. A "two-dimensional" structural component is one in which the profile constituting the structural component may be considered to be in a single plane, i.e., a single plane intersects the profile throughout the length of the profile. Otherwise, the profile is considered to be "three-dimensional."

To obtain a closed annular structural component, the ends located in one plane after shaping are joined to one another by way of a non-detachable connection. This can be done by welding or adhesive bonding, for example.

The annular structural component can be designed to have a circular shape or any arbitrary approximately polygonal shape, wherein radii provided in the corner regions can be designed to be constant or increase or decrease.

The system used to carry out the method essentially comprises an ingot storage, an ingot heating furnace, an extrusion press comprising guide tools for generating a helical shape, a separating device, a shaping device, and optionally a device for non-detachably connecting the ends of the annular structural component.

The shaping device can be designed as a bending and/or straightening device. The shaping device is used to form the helical shapes into a two-dimensional or three-dimensional structural component. The shaping device preferably comprises a two-part shaping tool, having upper and/or lower halves that can be displaced relative to one another. By applying pressure to at least one of the tool halves via at least one pressing cylinder, the structural components are shaped, and more particularly to a uniform dimension or to a uniform shape. At the same time, the structural components are straightened. Depending on the design of the tool halves of the shaping device, the structural components can be brought into a two-dimensional or three-dimensional shape.

Furthermore, it is possible to integrate stamping dies, or cutting or punching tools, into one or both tool halves, thereby providing the option to carry out stamping operations on the surfaces and/or to carry out cutting and/or punching operations during the shaping process.

One advantage of the invention is that the hot forming takes place during the manufacturing process, starting from the extrusion process to the shaping process, and the hot forming temperature ranges from 150° C. to 600° C., depending on the light metal used.

When magnesium or a magnesium alloy is used, the hot forming temperature ranges from 250° C. to 450° C.

The invention will be described in more detail based on one exemplary embodiment.

BRIEF DESCRIPTION OF THE DRAWINGS

The drawing shows the system for producing a closed annular structural component.

DETAILED DESCRIPTION OF THE INVENTION

The system according to FIG. 1 comprises an ingot storage 1 for storing the extrusion billet 4, the heating furnace 2, in which the extrusion billets 4 are heated to the extrusion temperature, and the extrusion press 3 comprising the guide tools 5 for generating a helical shape 9. Downstream thereof is a shaping device 7 and a joining device 8, in which the shaped ends of the helical shape 9 are joined to yield a closed annular structural component 10.

The extrusion billets 4 heated to the press temperature are inserted into the container of the extrusion press 3 and formed into an extruded profile. The extruded profile exiting the die of the extrusion press 3 is then formed into a helical shape 9 by way of the guide tools 5, and more particularly such that the ends of the helical shape 9 overlap slightly.

Thereafter, the extrusion press 3 is stopped, and the helical shape 9 is separated from the exiting extruded profile at the location of the overlapping ends by way of a separating device 6, which is designed as a flying saw. Subsequent to the separating process, the severed helical shape 9 is transferred to a shaping device 7, in which this is shaped, for example into an annular structural component 10. The shaping device 7 creates a structural component 10 having a high dimensional accuracy and contour accuracy, and more particularly in the form of a ready-to-install component.

Subsequent to the shaping operation, the ends are connected by a non-detachable connection in the connecting device 8, for example by way of welding. The ready-to-install component leaves the systems in this way.

The invention claimed is:

1. A method for producing a structural component, comprising:

extruding a metal through a die of an extrusion press to provide an extruded profile in a form of a continuous strip;

shaping the continuous strip as it exits the die into a nonplanar configuration having a polygonal shape with corner regions, the continuous strip in the nonplanar configuration having two overlapping ends arranged in separate planes;

separating a predetermined length of the extruded profile from the continuous strip, the length being predetermined such that the two ends overlap sufficiently to provide a site for inseparably connecting the two ends; and forming the nonplanar configuration into an endless configuration constituting the structural component.

2. The method according to claim 1, wherein the metal is magnesium.

3. The method according to claim 1, further comprising inseparably connecting the two ends at the overlap to form the nonplanar configuration into the endless configuration constituting the structural component.

4. The method according to claim 1, wherein shaping the extruded profile into the nonplanar configuration as it exits the die is carried out while the profile is in a heated, formable state.

5. The method according to claim 1, wherein the structural component is part of an automotive space frame.

6. The method according to claim 1, wherein shaping the continuous strip as it exits the die into the nonplanar configuration is effected by a guide tool which comprises at least two parts which are displaceable relative to each other.

7. The method according to claim 6, wherein the guide tool comprises a pressing cylinder which selectively applies pressure to at least one of the at least two parts.

8. The method according to claim 1, wherein the extruded profile is hollow.

9. A system for producing a structural component, the system comprising a production line comprising, in the following sequence:

a site for storage of ingots of a metal;

a furnace configured to receive and heat the ingots;

an extrusion press having a die, the extrusion press being configured to receive the heated ingots from the furnace and extrude a profile in form of a continuous strip;

a guide tool configured to shape the continuous strip as it exits the die into a nonplanar configuration in which the continuous strip has two overlapping ends arranged in separate planes, the guide tool comprising at least two parts which are displaceable relative to each other;

a separating device configured to separate a predetermined length of the profile from the continuous strip; and a device for inseparable connecting the two overlapping ends of the separated profile at the overlap to provide the structural component.

* * * * *